US011312555B2

(12) United States Patent
Tamarindo

(10) Patent No.: US 11,312,555 B2
(45) Date of Patent: Apr. 26, 2022

(54) CAP AND CAP-SPOUT ASSEMBLY

(71) Applicant: GUALA PACK S.P.A., Castellazzo Bormida (IT)

(72) Inventor: Stefano Tamarindo, Castellazzo Bormida (IT)

(73) Assignee: GUALA PACK S.P.A., Castellazzo Bormida (IT)

( * ) Notice: Subject to any disclaimer, the term of this patent is extended or adjusted under 35 U.S.C. 154(b) by 0 days.

(21) Appl. No.: 16/759,816

(22) PCT Filed: Oct. 26, 2018

(86) PCT No.: PCT/IB2018/058380
§ 371 (c)(1),
(2) Date: Apr. 28, 2020

(87) PCT Pub. No.: WO2019/123037
PCT Pub. Date: Jun. 27, 2019

(65) Prior Publication Data

US 2020/0307886 A1 Oct. 1, 2020

(30) Foreign Application Priority Data

Dec. 18, 2017 (IT) ..... 102017000145563

(51) Int. Cl.
*B65D 75/58* (2006.01)
*B65D 47/06* (2006.01)
*B65D 47/10* (2006.01)

(52) U.S. Cl.
CPC ..... *B65D 75/5883* (2013.01); *B65D 47/061* (2013.01); *B65D 47/10* (2013.01); *B65D 2575/583* (2013.01)

(58) Field of Classification Search
CPC ... B65D 75/5883; B65D 47/061; B65D 47/10
USPC ..... 222/566; 220/705
See application file for complete search history.

(56) References Cited

U.S. PATENT DOCUMENTS 427,256 A * 5/1890 Eggers ..... B65D 75/5883 383/80
2,062,216 A * 11/1936 Fink ..... B65D 47/121 222/552
2,117,407 A * 5/1938 Davis ..... B65D 41/045 220/288

(Continued)

FOREIGN PATENT DOCUMENTS

FR 2892096 A1 4/2007
JP 2001247144 A 9/2001

(Continued)

OTHER PUBLICATIONS

International Search Report and Written Opinion for International Patent Application No. PCT/IB2018/058380, dated Feb. 5, 2019, 11 pages.

(Continued)

*Primary Examiner* — Paul R Durand
*Assistant Examiner* — Michael J. Melaragno
(74) *Attorney, Agent, or Firm* — Armstrong Teasdale LLP

(57) ABSTRACT

A spout for a pouch that includes a rigid spout body and a soft cover externally coating a tube of the spout body is provided. The tube is threaded internally. A cap includes a tang with an external thread for screwing onto the spout.

11 Claims, 7 Drawing Sheets

(56) References Cited

U.S. PATENT DOCUMENTS 2,717,721 A * 9/1955 Gibson ..... B65D 35/12 222/92
2,717,728 A * 9/1955 Gray ..... 222/546
3,318,496 A * 5/1967 Ayotte ..... B65D 47/123 222/546
3,690,524 A * 9/1972 Haberhauer ..... B29C 66/232 222/573
4,802,597 A * 2/1989 Dubach ..... B65D 41/265 141/381
5,823,383 A * 10/1998 Hins ..... B29C 65/02 220/601
6,062,435 A * 5/2000 Hess, III ..... B65D 47/2031 222/175
6,158,622 A * 12/2000 Igarashi ..... B65D 47/10 222/107
6,199,729 B1 * 3/2001 Drzymkowski ..... A45F 3/20 138/120
6,241,122 B1 * 6/2001 Araki ..... B65D 47/06 222/107
6,273,307 B1 * 8/2001 Gross ..... B65D 75/5883 220/613
6,279,772 B1 * 8/2001 Bowman ..... B65D 47/2031 220/703
6,439,429 B1 * 8/2002 Gross ..... B65D 41/34 222/92
6,860,406 B2 * 3/2005 Kobetsky ..... B29C 65/18 222/92
7,232,042 B2 * 6/2007 Last ..... B65D 75/5883 222/1
7,597,244 B2 * 10/2009 Boldrini ..... B65D 15/22 229/110
7,959,045 B2 * 6/2011 Kuge ..... B65D 47/123 222/495
8,083,102 B2 * 12/2011 Murray ..... B65D 47/147 222/107
8,672,182 B2 * 3/2014 Bonet Pedrol ..... B65D 75/5883 222/92
9,016,505 B2 * 4/2015 Canegallo ..... B65D 75/5866 220/277
9,221,592 B2 * 12/2015 Murray ..... B65D 75/5883
10,442,582 B1 * 10/2019 Ekkert ..... B29C 66/232
10,486,880 B2 * 11/2019 Franca ..... B29C 66/006
2002/0148806 A1 * 10/2002 Cheng ..... A45F 3/18 215/388
2004/0159820 A1 * 8/2004 Yang ..... A45F 3/16 251/342
2005/0242130 A1 11/2005 Yang
2006/0201967 A1 * 9/2006 Romer ..... B65D 75/5883 222/92
2007/0205229 A1 * 9/2007 Schmeisser ..... B65D 47/061 222/525
2009/0223963 A1 * 9/2009 Bisio ..... B65D 41/3433 220/304
2010/0213213 A1 * 8/2010 Albers ..... B65D 41/3409 222/153.05
2011/0108613 A1 * 5/2011 Stribling ..... B65D 77/28 229/103.1
2011/0127232 A1 * 6/2011 Willows ..... B65D 47/088 215/354
2011/0151069 A1 * 6/2011 Harding ..... A61J 11/0095 426/117
2012/0211460 A1 * 8/2012 Tamarindo ..... B65D 41/0485 215/228
2014/0097211 A1 * 4/2014 Oates, II ..... B65D 75/5883 222/566
2015/0144632 A1 * 5/2015 Tamarindo ..... B65D 41/3404 220/265
2015/0147430 A1 * 5/2015 Dzikowicz ..... A23L 2/00 426/2
2015/0307244 A1 * 10/2015 Tamarindo ..... B65D 51/24 215/228
2016/0122095 A1 * 5/2016 Berge ..... B65D 75/008 222/92
2016/0145025 A1 * 5/2016 Van Der Molen ..... B65B 1/02 222/107
2016/0318684 A1 11/2016 Jo et al.
2018/0111726 A1 * 4/2018 Hoefte ..... B65D 47/061
2018/0147814 A1 * 5/2018 Sato ..... B32B 27/36
2018/0201415 A1 * 7/2018 Berge ..... B65D 75/5883
2018/0265259 A1 * 9/2018 Berge ..... A61L 2/02
2018/0346219 A1 * 12/2018 Murray ..... B65D 51/18
2019/0119024 A1 * 4/2019 Tamarindo ..... B65B 3/10
2019/0168924 A1 * 6/2019 Tamarindo ..... B65D 47/122
2021/0002045 A1 * 1/2021 Lin ..... B65D 47/122
2021/0039847 A1 * 2/2021 Umenaka ..... B65D 41/34

FOREIGN PATENT DOCUMENTS

WO 2008050361 A1 5/2008
WO 2018020365 A1 2/2018

OTHER PUBLICATIONS

International Preliminary Report on Patentability for International Patent Application No. PCT/IB2018/058380, dated Oct. 24, 2019, 9 pages.

* cited by examiner

CAP AND CAP-SPOUT ASSEMBLY

CROSS-REFERENCE TO RELATED APPLICATIONS

This application is a National Stage Application of International Patent Application No. PCT/IB2018/058380, having an International Filing Date of Oct. 26, 2018, which claims the benefit of priority to Italian Patent Application No. 102017000145563, filed Dec. 18, 2017, the entire contents of which are hereby incorporated by reference herein.

FIELD OF THE INVENTION

The object of the present invention is an assembly of a cap and a spout, in particular for thin-body flexible containers, generally known as "pouches", usually used for containing liquid or dense food products, such as fruit juices, fruit puree, yogurt, energy drinks and the like.

BACKGROUND OF THE INVENTION

Such pouches have been very popular for some years, especially in the field of products for children, due mainly to their convenience of use: it is sufficient to unscrew the cap and drink directly from the spout, possibly squeezing the pouch in the case of dense products.

Typically, the spout is made of plastic material, rigid enough to ensure a stable screwing of the cap, which is also made of plastic material.

This however, involves some drawbacks. For example, when the spout is held between the lips in order to drink the product, it may give the user an unpleasant sensation on the lips due to a certain surface roughness of the plastic.

Or, it is possible that the edge of the spout hits the user's teeth.

SUMMARY OF THE INVENTION

The object of the present invention is to create a cap and spout assembly that overcomes the drawbacks mentioned and at the same time satisfies the requirements of the sector.

Such object is achieved by a spout, a cap and a cap-spout assembly having the features described below.

BRIEF DESCRIPTION OF THE DRAWINGS

The features and advantages of the invention will be apparent from the description given below, provided by way of non-limiting example, according to the accompanying figures, wherein.

DETAILED DESCRIPTION

Figure 1:
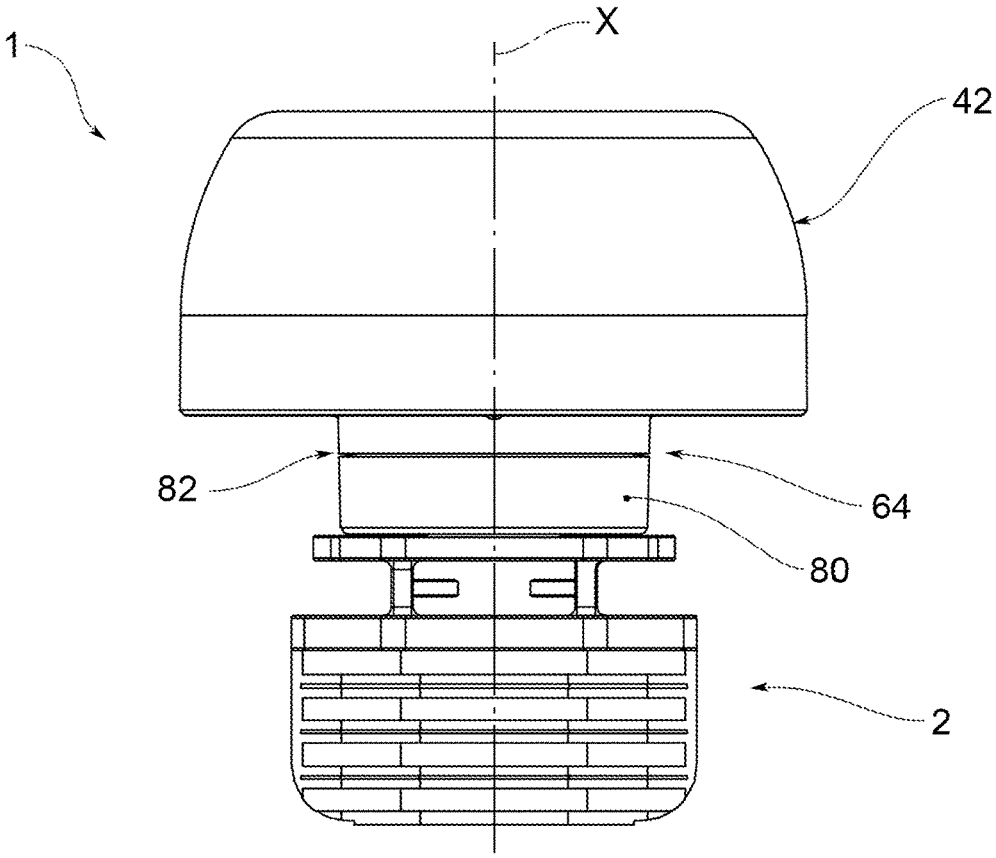
FIG. 1 shows a cap-spout assembly according to the present invention, from a front view.
Figure 2:
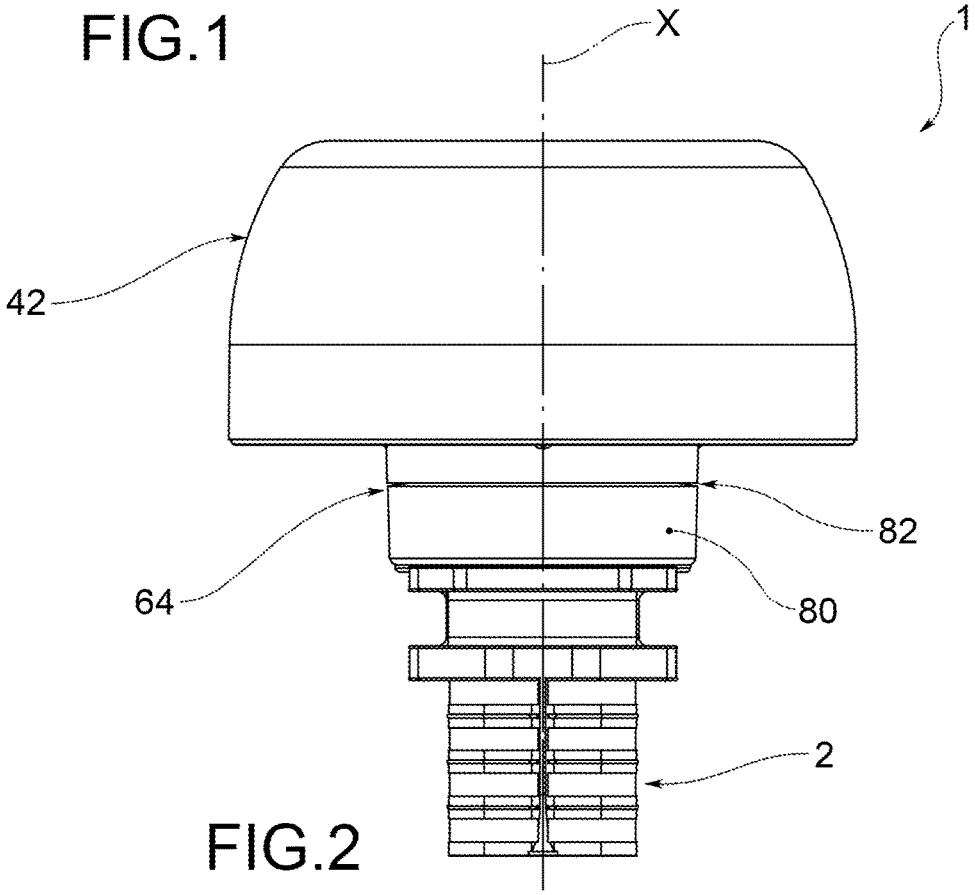
FIG. 2 shows the assembly of FIG. 1, from a side view.
Figure 5:
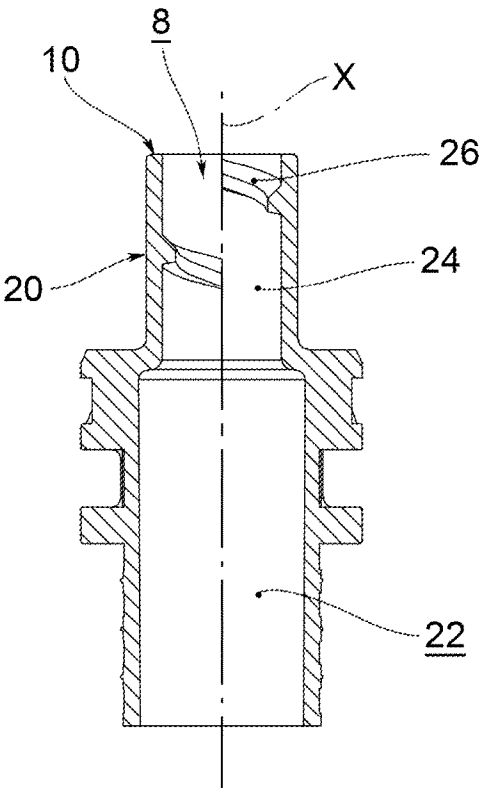
FIG. 5 illustrates a cross-sectional view of the spout body of FIG. 3, according to the cross-sectional plane V-V in FIG. 3.
Figure 4:
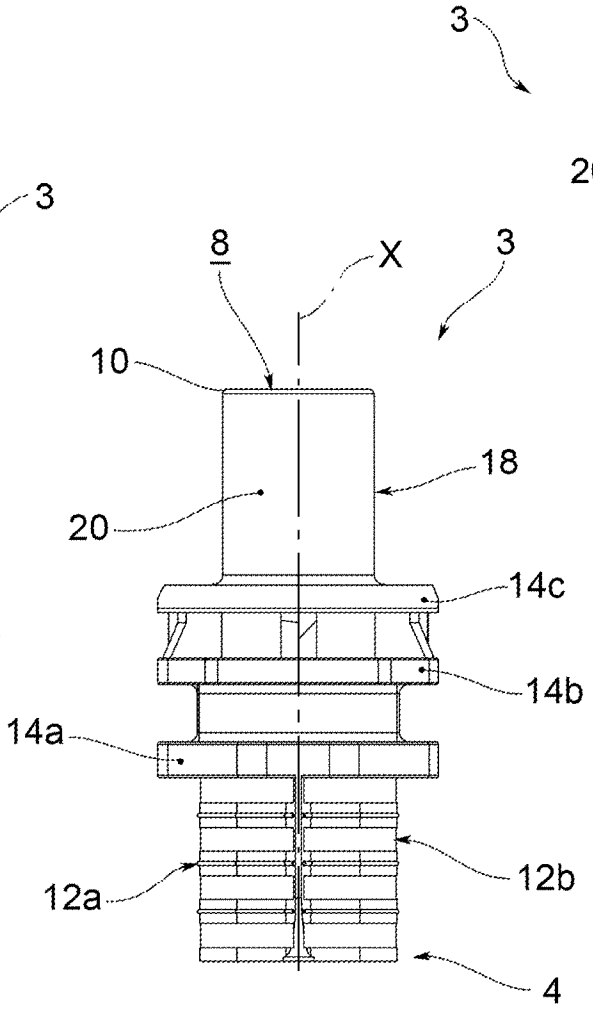
FIG. 4 shows the spout body of FIG. 3, from a side view.
Figure 3:
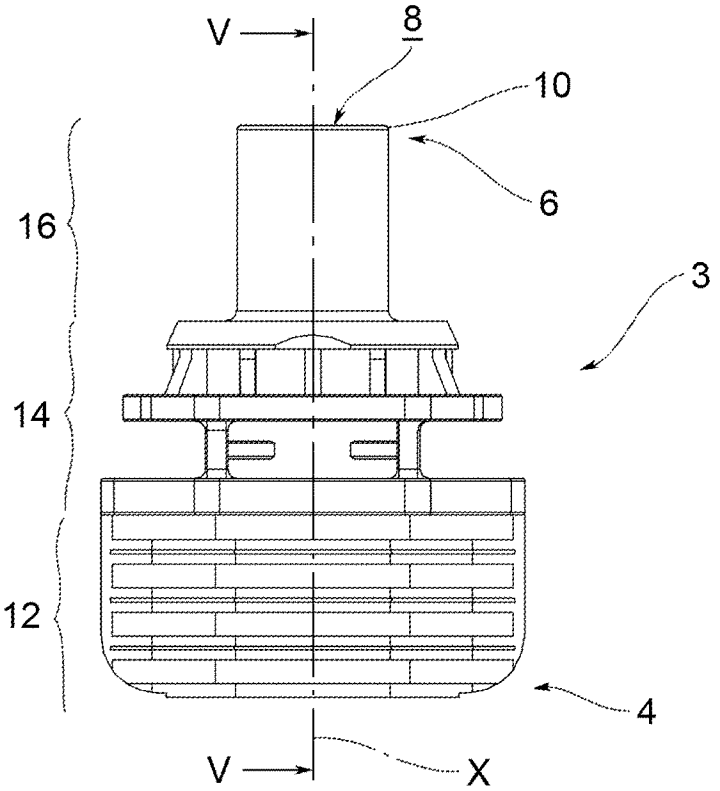
FIG. 3 illustrates a spout body of the assembly, from a front view.
Figure 6:
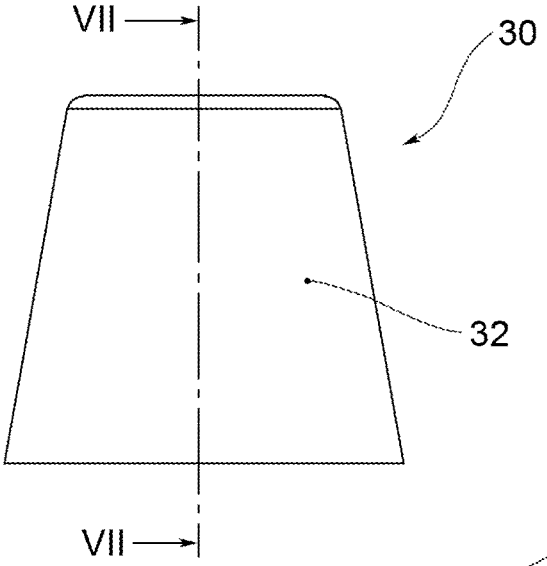
FIG. 6 shows a cover of the assembly.
Figure 7:
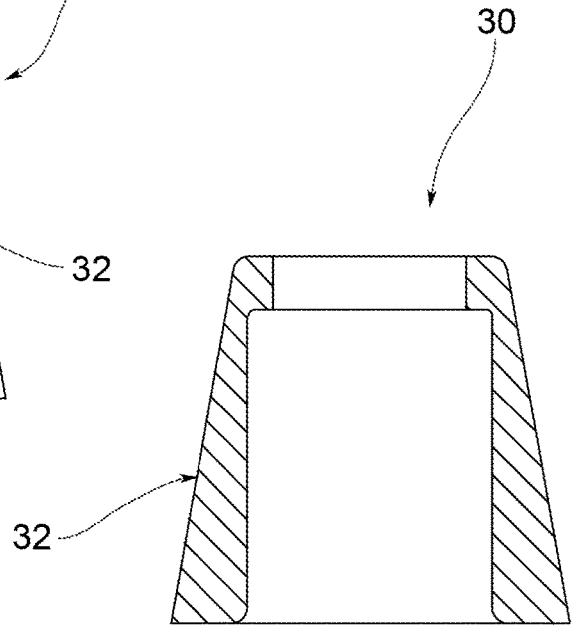
FIG. 7 is a cross-sectional view of the cover of FIG. 6, according to the cross-sectional plane VII-VII in FIG. 6.
Figure 10:
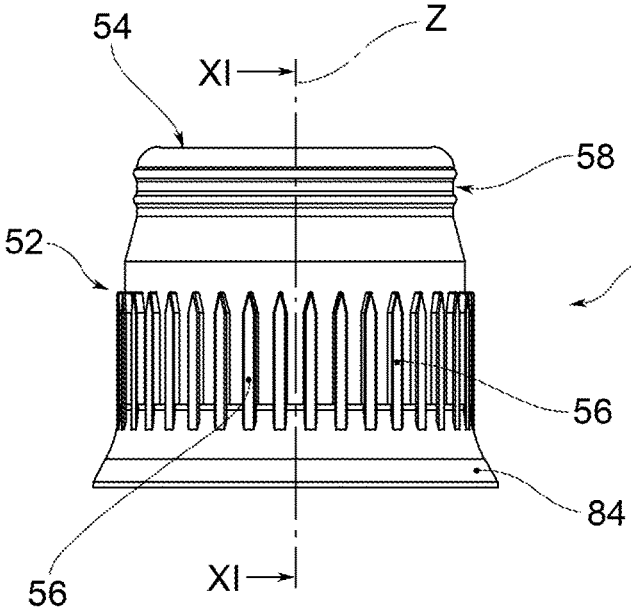
FIG. 10 shows a closure of the assembly of FIGS. 8 and 9.
Figure 11:
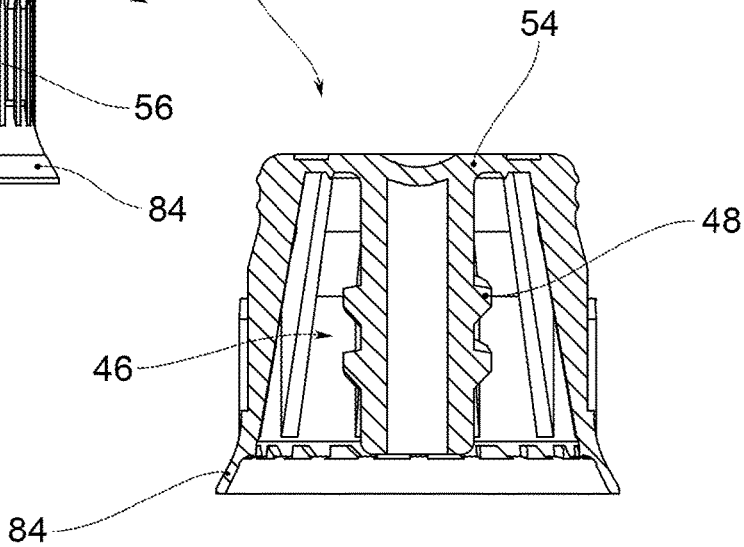
FIG. 11 illustrates a cross-sectional view of the closure of FIG. 10, according to the cross-sectional plane XI-XI in FIG. 10.
Figure 9:
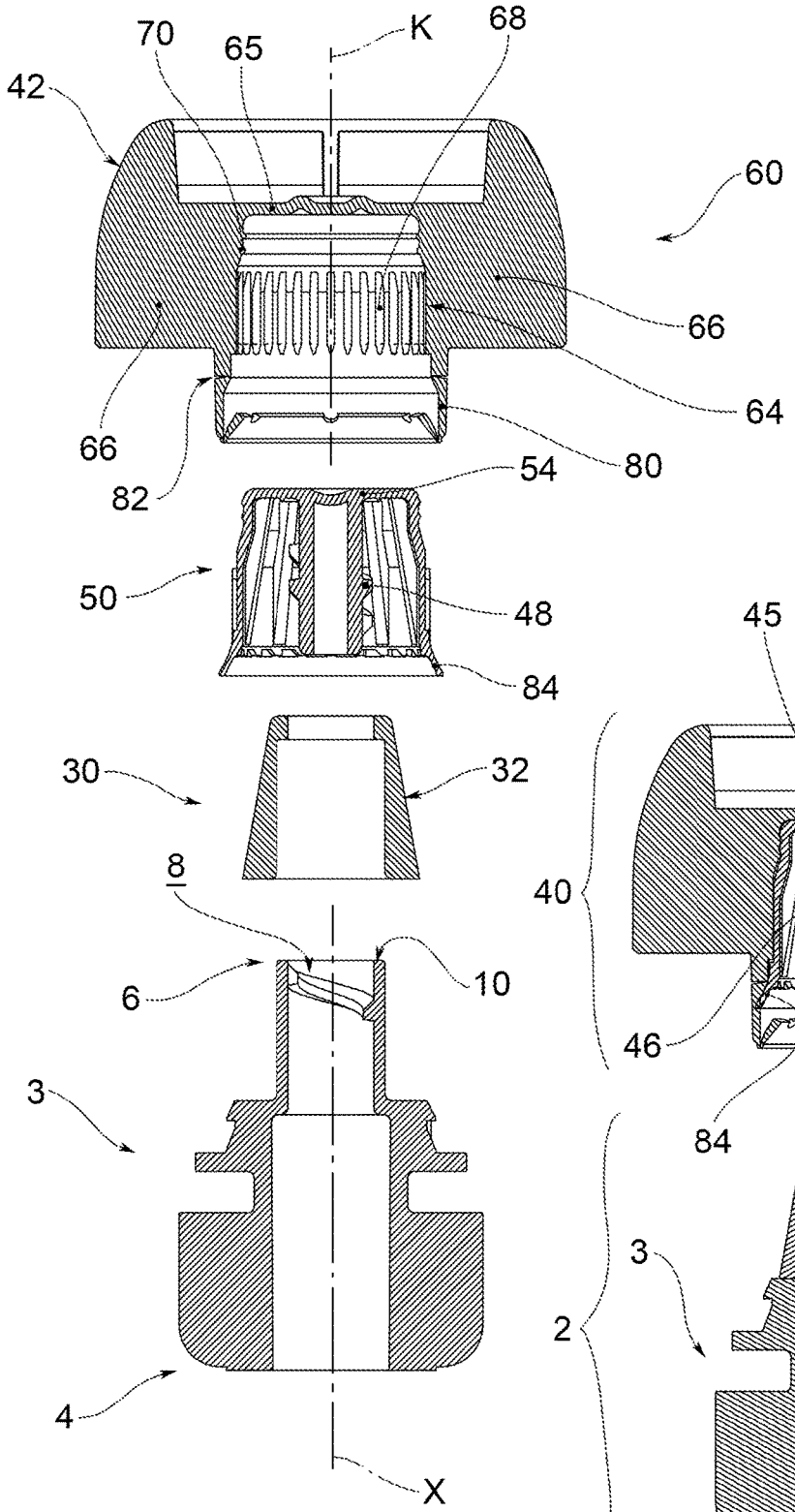
FIG. 9 shows the assembly according to the present invention, wherein all the parts are separated.
Figure 8:
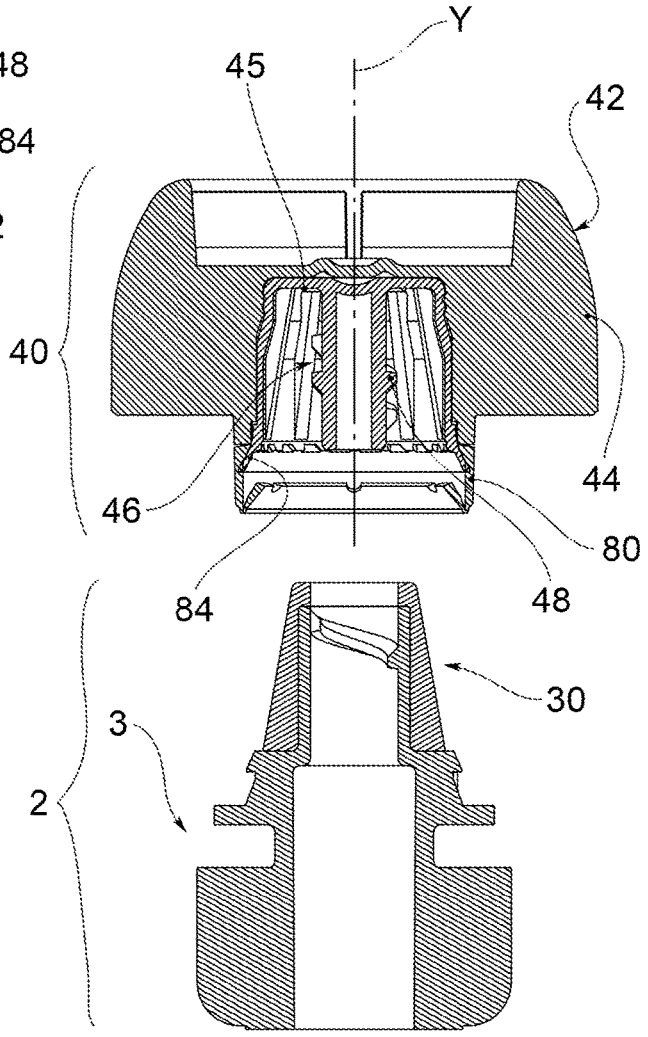
FIG. 8 shows an assembly according to the present invention, wherein the spout and the cap are separated.
Figure 13:
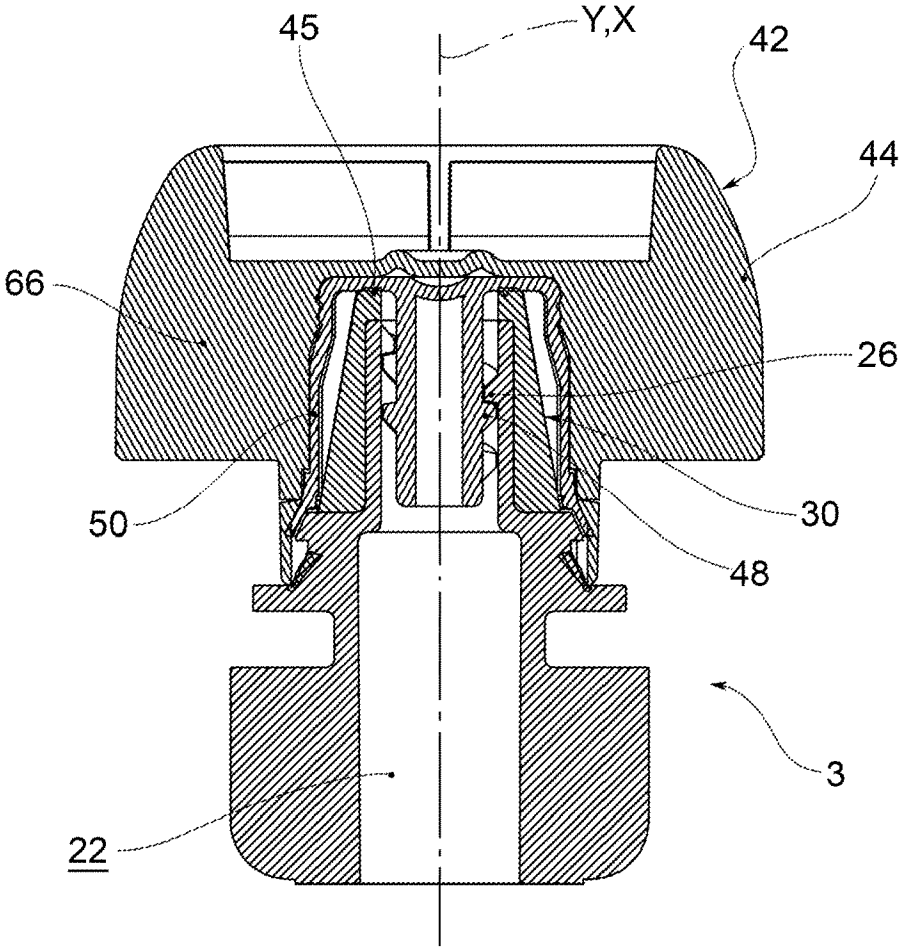
FIG. 13 shows a cross-sectional view of the assembly of FIG. 12 from a front view.
Figure 12:
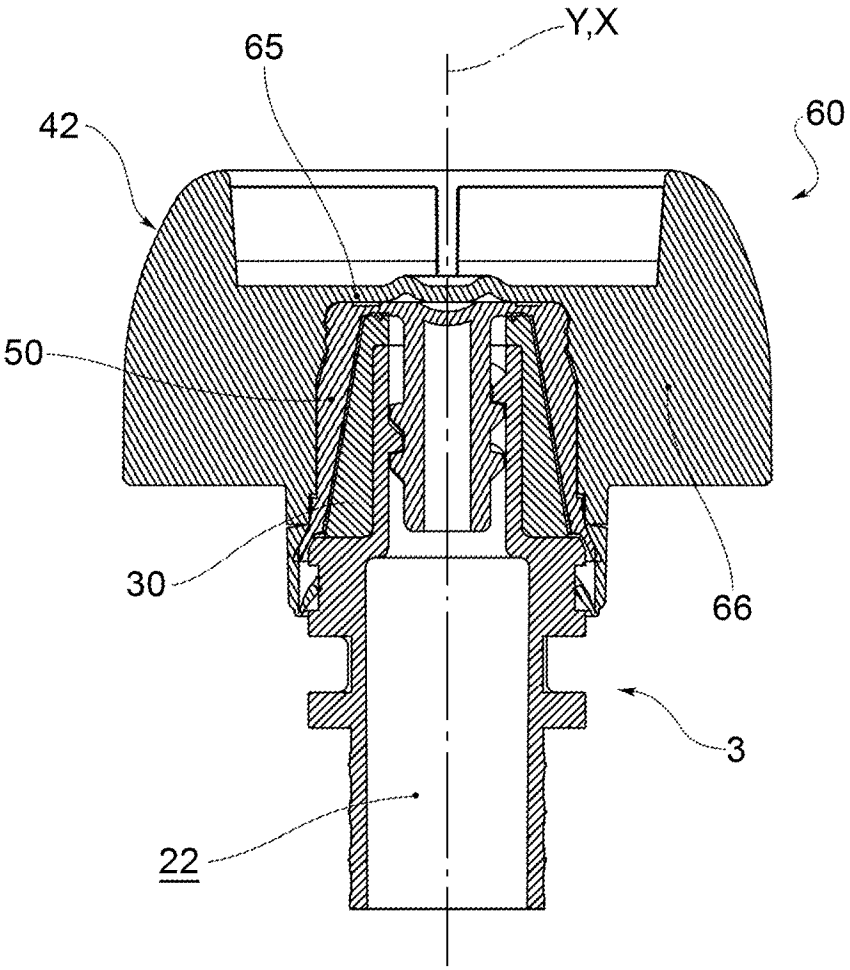
FIG. 12 is a cross-sectional view of the assembly according to the present invention, in a closed configuration, according to a side view.
Figure 14:
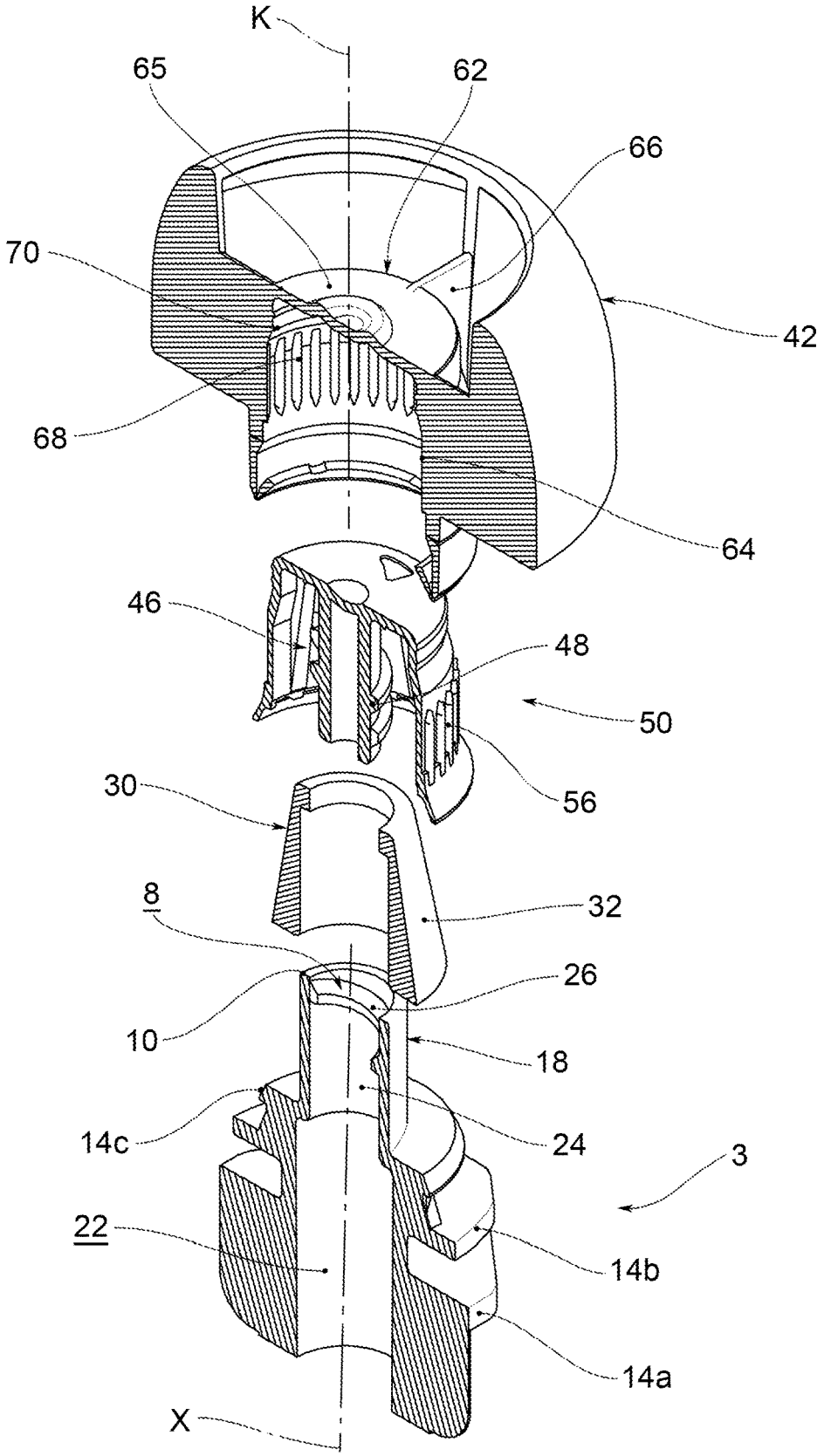
FIGS. 14, 15 and 16 show the assembly according to the present invention respectively in separate parts, with the cap separated from the spout and in a closed configuration.
Figure 16:
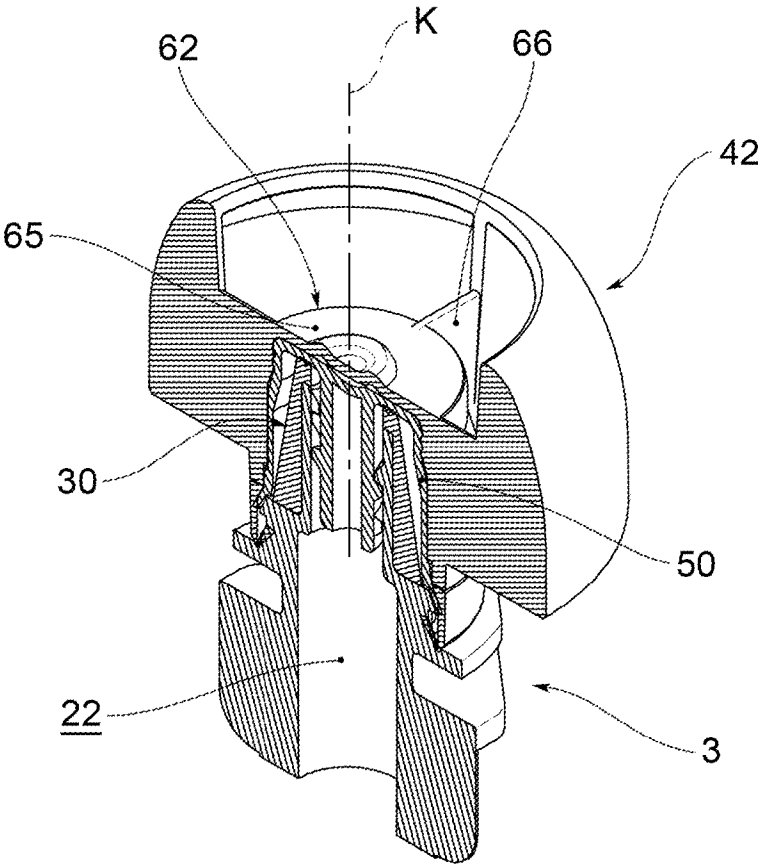
Figure 15:
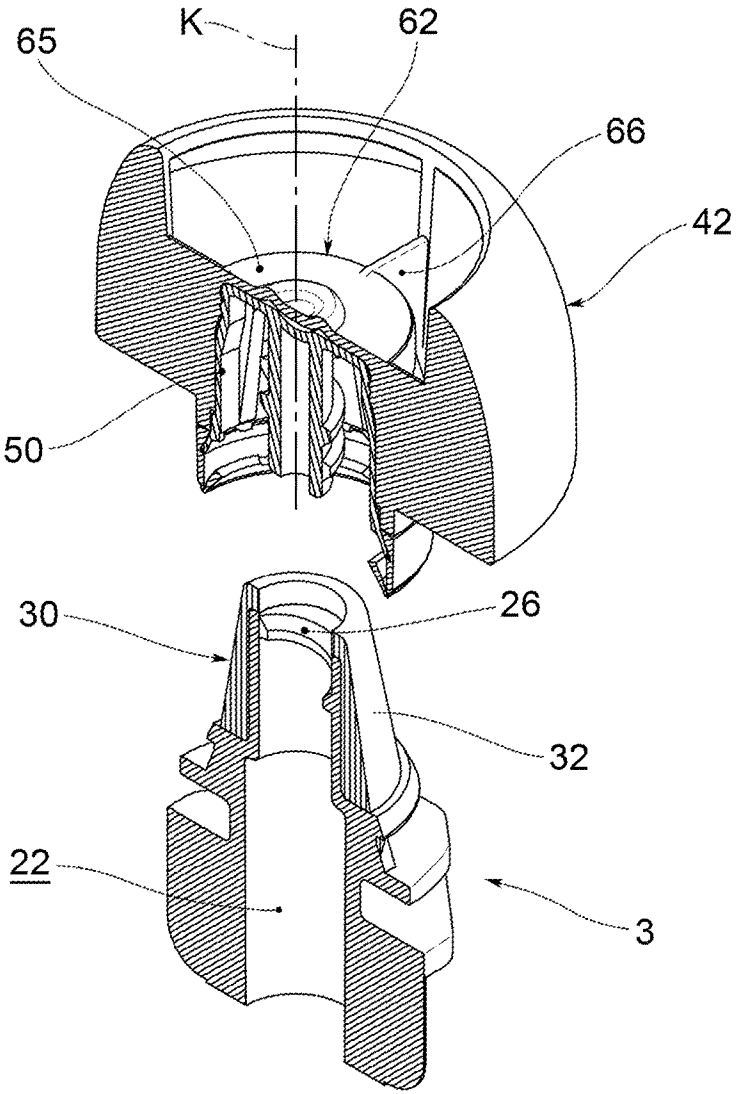

With reference to the accompanying figures, a cap-spout assembly for a thin-body flexible container, in jargon called "pouch", is indicated collectively at 1.

Typically, a flexible pouch consists of two facing front walls made of flexible material, typically a polymeric film, single-layer or multi-layer, welded along their respective peripheral edges.

At the upper edges, a spout 2 of the assembly 1 is inserted between the two front walls.

The spout 2 comprises a spout body 3, made of a single piece of the same plastic material, for example polyethylene (PE) or polypropylene (PP).

The internally hollow spout body 3 extends along a straight spout axis X between a lower end 4, intended to be inserted between the upper edges of the walls of the pouch, and an opposite upper end 6, where a spout mouth 8 for the product to exit is found, delimited by a spout edge 10.

From the lower end 4 to the upper end 6, the spout body 3 comprises a connecting portion 12, an intermediate portion 14 and an end portion 16.

The connecting portion 12 consists of a region with two opposite faces 12*a*, 12*b*, which together form the so-called "welding rim", on which are welded the upper edges of the walls of the pouch.

The intermediate portion 14, flanked axially by the connecting portion 12, comprises:

- a lower plate 14*a*, substantially perpendicular to the spout axis X, delimiting the connecting portion 12, substantially rhomboidal in shape with rounded corners;
- an intermediate plate 14*b*, axially spaced from the lower plate 14*a*; and
- an upper plate 14*c*, axially spaced from the intermediate plate 14*b*.

The end portion 16 is flanked axially by the intermediate portion 14 and consists of a tube 18 extending from the upper plate 14*c* to the mouth 8 of the spout body 3.

The tube 18 has an outer tube surface 20, preferably circular cylindrical. Said outer tube surface 20, which extends from the upper plate 14*c* to the spout edge 10, is smooth, i.e. it is free of any ridges or depressions.

Internally, the spout body 3 is hollow and has a lower duct 22, which preferably extends through the connecting portion 12 and the intermediate portion 14, and an outlet duct 24, which preferably extends through the upper portion 16, i.e. through the tube 18.

Preferably, the outlet duct 24 has a section with a diameter smaller than the diameter of the lower duct 22.

The tube 18 of the spout body 3 has a continuous or interrupted inner thread 26; in other words, the spout body 3 has a thread 26 contained in the outlet duct 24 of the tube 18.

The spout 2 further comprises a cover 30 made of a soft material, i.e. less rigid than the plastic material that forms the spout body, and inert, so as to be suitable for contact with the user's lips and insertion into the mouth.

For example, said cover 30 is made of silicone or a thermoplastic elastomer (TPE).

The cover 30 coats externally, at least in part, the tube 18, and in particular coats part of the outer tube surface 20 and the spout edge 10 which, shaped like a circular crown lying on an imaginary plane orthogonal to the spout axis X, surrounds the mouth 8 of the spout 2.

Preferably, the cover 30 completely coats the outer tube surface 20, i.e. from the spout edge 10 to the upper plate 14*c* of the intermediate portion 14 of the spout body 3.

According to one embodiment, the cover 30 has externally an outer cover surface 32 essentially frusto-conical, flared towards the intermediate portion 14 of the spout body 3.

According to one embodiment, the cover 30 is made in one piece, separately from the spout body, and then applied thereto, for example by means of mechanical coupling, such as a snap coupling, or chemical, using adhesives.

According to a further embodiment, the cover is made separately from the spout body and then applied thereto by means of the co-molding process, i.e. by introducing the already-formed cover into the mold wherein the spout body will be formed (or vice versa, i.e. introducing the already-formed spout body into the mold wherein the cover will be formed).

According to a still further embodiment, the cover is made simultaneously with the spout body, for example by means of a bi-injection process.

The cap-spout assembly 1 further comprises a cap 40, which is screwable to the spout 2. In particular, said cap 40 is screwable to the inner thread 26 of the tube 18.

According to one embodiment, the cap 40 comprises a handle 42 consisting of an annular outer cap wall 44 around a cap axis Y, continuous or consisting of separate portions, a closing wall 45 perpendicular to the cap axis Y, and a tang 46 inside the handle 42, coaxial to said cap axis Y, protruding axially from said closing wall 45.

The tang 46 is equipped with an outer thread 48 for screwing into the inner thread 26 of the tube 18 of the spout 2.

When the cap 40 is screwed onto the spout 2, the closing wall 45 closes the mouth 8 of the spout 2, preventing the escape of the product contained in the flexible pouch.

According to a preferred embodiment, the cap 40 consists of two components: a closure 50 and a top cap 60, engaged to each other.

The closure 50 is made as a single piece out of plastic material, for example, polyethylene (PE) or polypropylene (PP), and consists of a side closing wall 52 annular around a closing axis Z and a bottom closing wall 54, orthogonal to the closing axis Z, which closes the side closing wall 52 at one end.

Internally, from the bottom closing wall 54, which functionally forms said closing wall 45 of the cap 40, the tang 46 protrudes, provided with the outer thread 48, coaxially to the closure axis Z.

Preferably, the tang 46 is internally hollow.

The top cap 60 is made as a single piece out of plastic material, for example polyethylene (PE) or polypropylene (PP), and comprises the handle 42, consisting of the outer cap wall 44, and a casing 62, inside the handle 42.

The casing 62 consists of an annular inner cap wall 64 around a top cap axis K and a bottom cap wall 65 that closes the inner cap wall 64 at one end.

Preferably, the casing 62 is connected to the handle by means of a plurality of tabs 66, for example angularly equally spaced, preferably contained in imaginary planes containing the top cap axis K.

The casing 62 is suitable for housing the closure 50, constraining it axially and rotationally.

For example, according to one embodiment, the closure 50 has a plurality of ridges 56 protruding from the outer surface of the side closure wall 52, which are substantially axial and arranged in a circumferential succession.

Correspondingly, the casing 62 has on the inner surface of the inner cap wall 64, a plurality of ridge seats 68, each ridge seat 68 being suitable to accommodate the respective ridge 56 of the closure 50, thus creating a rotational constraint between the top cap 60 and the closure 50.

Moreover, according to one embodiment, the closure has a circumferential groove 58, near the bottom closure wall 54, on the outer surface of the side closure wall 52.

Correspondingly, the casing 62 of the top cap 60 has a circumferential rib 70, continuous or continuous in sections, protruding from the inner surface of the inner cap wall 64, near the bottom cap wall 65.

Once the closure 50 is inserted in the casing 62, the rib 70 snaps into the groove 58, forming an axial constraint between the top cap 60 and the closure 50.

The cap 40, and in particular the top cap 60, is also provided, in a preferred embodiment, with a guarantee seal suitable to indicate the first opening of the cap from the spout.

For example, said guarantee seal is described in the International Application WO-A1-2018/020365 or the International Application WO-A1-2008/050361, both of the Applicant, the teaching of which is incorporated herein.

When the cap and spout are screwed together, the closing wall 45 of the cap 40 closes the mouth 8 of the spout 2 by pressing on a portion of the cover 30.

At the same time, when the cap and the spout are screwed together, an inner cap wall 64 engages the upper plate 14*c* of the spout 2 to form a guarantee seal.

In particular, the inner cap wall 64 comprises an end strip 80 connected to the remaining part of the inner cap wall 64 via a breakable septum 82.

Moreover, the closing side wall 52 comprises an end lip 84 which, when not deformed, protrudes radially from the outside of the remaining part of the closing side wall 52.

When the closure 50 is contained in the casing 62, the end lip 84 is deformed and radially contained within the end strip 80 of the casing 62.

When the cap is applied to the spout, the end strip 80 engages the upper plate 14*c* of the spout 2, so that it cannot be removed axially from the spout.

When the cap is first unscrewed from the spout, the breakable septum 82 breaks (as the cap tends to separate from the spout while the end strip 80 is engaged thereto) and the end lip 84 of the closure 50 expands to the outside, becoming visible.

By screwing the cap back on to the spout, the end lip 84 is placed between the remaining part of the inner cap wall 64 and the end strip 80, which has remained attached to the spout, remaining clearly visible so as to indicate that the pouch has been opened.

Innovatively, the cap-spout assembly described above overcomes the drawback mentioned with reference to the prior art, as it allows the user to hold between the lips a soft and ergonomic cover.

Moreover, the two-component cap (closure and top cap) allows for particularly advantageous and reliable production, even in the case of high production volumes.

It is apparent that one skilled in the art, in order to meet contingent needs, may make changes to the cap-spout assembly and to the individual components described above, all contained within the scope of protection as defined by the following claims.

The invention claimed is:

1. A spout for a thin-walled flexible pouch, the spout comprising a spout body and a cover, wherein:

said spout body is made of a first plastic material, is internally hollow, and comprises:

a tube including an outlet duct and an internal thread, said tube extending along a straight spout axis, wherein said tube ends with a mouth for dispensing a product contained in the pouch;

a connecting portion provided with a welding rim; and an intermediate portion alongside said connecting portion, said intermediate portion comprising an upper plate, wherein said tube extends from said upper plate to said mouth, wherein a lower duct extends axially from the outlet duct opposite to said mouth, the lower duct extending along the spout axis through said connecting portion and said intermediate portion;

said cover is made of a second material, softer than said first plastic material, and externally coats, at least partially, said tube, to form a comfortable mouthpiece for a user; and said mouth is peripherally delimited by a spout edge having a circular crown shape, said cover covers said spout edge, and said cover is tapered outwardly from said mouth to said upper plate.

2. The spout of claim 1, wherein the outlet duct has a diameter smaller than a diameter of the lower duct.

3. The spout of claim 1, wherein said cover is located between said spout body and a cap when the cap is coupled to the spout.

4. The spout of claim 1, wherein an outer tube surface of said tube is smooth from said upper plate to said mouth.

5. The spout of claim 1, wherein said cover abuts said upper plate.

6. A cap-spout assembly comprising:

a spout for a thin-walled flexible pouch, said spout comprising a spout body and a cover, wherein said spout body is made of a first plastic material, is internally hollow and comprises:

a tube including an outlet duct and an internal thread, said tube extending along a straight spout axis, wherein said tube ends with a mouth for dispensing a product contained in the pouch;

a connecting portion provided with a welding rim; and an intermediate portion alongside said connecting portion, said intermediate portion comprising an upper plate, wherein said tube extends from said upper plate to said mouth, wherein a lower duct extends axially from the outlet duct opposite to said mouth, the lower duct extending along the spout axis through said connecting portion and said intermediate portion;

wherein said cover is made of a second material, softer than said first plastic material, and externally coats, at least partially, said tube, to form a comfortable mouthpiece for a user; and wherein said mouth is peripherally delimited by a spout edge having a circular crown shape and said cover covers said spout edge;

a cap for said spout, comprising a handle comprising an annular outer cap wall around a cap axis, a closing wall, radially contained inside said handle, which extends substantially on an imaginary plane perpendicular to said cap axis, and a tang projecting axially from said closing wall, coaxial to said cap axis and provided with an outer thread for screwing to said spout;

a closure, comprising said closing wall, said tang with said outer thread, and a side closing wall, closed at one end by said closing wall; and a top cap, comprising said handle and a casing contained radially inside said handle and integral therewith, said closure being housed in said casing, wherein said closure and said top cap are structurally separate and mutually engaged so as to be axially and rotationally constrained.

7. The cap-spout assembly of claim 6, wherein said casing is rotationally integral with said handle by a plurality of tabs angularly equally spaced.

8. The cap-spout assembly of the claim 6, further comprising a guarantee seal.

9. The cap-spout assembly of claim 6, wherein, when said cap and said spout are screwed together, said closing wall of said cap closes said mouth of said spout by pressing on a portion of said cover.

10. The cap-spout assembly of claim 6, wherein:

an inner cap wall of said top cap comprises an end strip connected to a remaining part of said inner cap wall via a breakable septum, a closing side wall of said closure comprises an end lip which, when not deformed, protrudes radially from outside of a remaining part of said closing side wall, when said closure is contained in said casing, said end lip is deformed and radially contained within said end strip of said casing, and said end strip engages an upper plate of said spout, so that it cannot be removed axially from said spout.

11. The cap-spout assembly of claim 6, wherein said cover is located between said spout and said cap.

* * * * *